United States Patent [19]

Effinger

[11] 4,076,112

[45] Feb. 28, 1978

[54] FREE PLATEN TYPEWRITER

[76] Inventor: Cecil S. Effinger, 828 Pearl St., Boulder, Colo. 80302

[21] Appl. No.: 681,822

[22] Filed: Apr. 30, 1976

[51] Int. Cl.[2] ..... B41J 13/03; B41J 11/04

[52] U.S. Cl. ..... 197/127 R; 197/114 R; 197/138 A; 197/145

[58] Field of Search ..... 29/110, 115; 197/114 R, 197/127 R, 129, 133 R, 138 R, 138 A, 144–147

[56] References Cited

U.S. PATENT DOCUMENTS

| | | | |
|---|---|---|---|
| 490,329 | 1/1893 | Webb | 197/127 R |
| 1,280,678 | 10/1918 | De Clamecy | 197/127 R |
| 1,293,252 | 2/1919 | Tucker | 197/114 R |
| 1,496,404 | 6/1924 | Barney | 197/144 |
| 1,517,506 | 12/1924 | Hess | 197/138 A |
| 1,606,999 | 11/1926 | Hokanson | 197/138 R |
| 2,152,858 | 4/1939 | Becker | 197/138 A |
| 2,346,163 | 4/1944 | Hiles | 197/133 P |
| 3,064,790 | 11/1962 | Emig | 197/127 R |
| 3,292,762 | 12/1966 | Erickson | 197/114 R |

*Primary Examiner*—Paul T. Sewell
*Attorney, Agent, or Firm*—Horace B. Van Valkenburgh; Frank C. Lowe

[57] ABSTRACT

The free platen has a weight inside to produce inertia against movement by typing, as well as extensible end pieces for extension to correspond to lateral extension of a paper guide. An adjustable end plate at each end of the typewriter frame carries a lower supporting and positioning roller which engages the platen at a point forwardly of the vertical centerline thereof and a rear supporting and positioning roller which is essentially opposite the point of impact of the typing element and engages the platen at a point below its horizontal centerline. The platen has a pair of ring gears having an outer diameter less than the thickness of the elastomer covering the platen between the gears, with a short section of elastomer beyond each ring gear. The ring gears are engaged by a gear of a pivoted indexing device, which gear engages the platen ring gear when the respective indexing device is in down position. The ratcheted indexing device is actuated by conventional levers, arms, etc. The rollers of a special bail engage the paper just above the printing line, the rollers being mounted on a rod supported by a forwardly extending bar at each end. A spring acting on each end bar provides a thrust force directed at an acute angle to a tangent to the platen at the point of engagement by the rollers. Conventional paper feed rollers are disposed underneath the platen but are pressed upwardly against the platen with sufficient force to hold the paper against the platen, but insufficient to lift the platen from its supporting rollers.

14 Claims, 14 Drawing Figures

FREE PLATEN TYPEWRITER

This invention relates to typewriters, and more particularly to free platen typewriters in which the ends of the platen are unobstructed, so that a piece of paper or the like may extend laterally beyond one or both ends of the platen and the typewriter is thus adapted to handle large sheets of paper or the like, on which various types of indicia are to be placed. Such indicia include, but are not limited to, drawings and diagrams, such as engineering drawings, industrial, electrical or electronic circuit drawings, lettering, heat flow diagrams, lighting diagrams, well drilling location and other geological maps, as well as others.

Examples of free platen typewriters include those of my prior U.S. Pat. Nos. 3,767,023 and 3,900,098, in which the platen itself has a length greater than the width of the frame in which the conventional parts of the typewriter are installed. The present typewriter includes the paper guide and extensible platen of my prior U.S. Pat. No. 3,900,098, with improvements in the latter. The present invention was in part conceived and developed in order to overcome the tendency for paper on a free platen to creep during use, with the result that a line of typing would creep upwardly or downwardly on the sheet. Another purpose is to overcome any tendency for a buckling effect of the paper to be produced. The solution includes support means mounted on adjustable end plates beneath the platen and opposite the area of printing impact, as well as releasable and adjustable paper feed rollers beneath the platen. The indicia producing means of the typewriter, such as key operated levers and especially the laterally movable printing element of the IBM "Selectric" typewriter, are utilized. The end rollers are mounted on adjustable end plates which normally support the end bearings for the platen of the well known "Selectric" typewriter; thus, the adjustment devices for the end plates, normally used to adjust the fixed platen bearings, may be used to adjust the support rollers for positioning the free platen. Also, a specially designed spring pressed bail produces sufficient force to wedge the paper against the platen and hold the paper more securely against the platen, particularly desirable in the case of large sheet materials of relatively great stiffness and mass. The paper feed rollers on the underside of the platen are retained but are adjustable upwardly or downwardly to press the paper against the platen in the usual manner for typewriters, rather than supporting or positioning the platen. A weight disposed centrally and extending longitudinally of the platen produces further resistance to printing impact, adds stability to the platen through inertia, and also increases the gripping action of the lower feed rollers on the paper.

The present typewriter further includes an indexing device which includes a drive gear engageable with a driven gear on the platen itself, for rotating the platen and the paper with it in desired increments, as through a ratchet and pawl arrangement. The gear driving device also includes a hand operated roller which may engage the platen at certain lateral positions of the platen, in which the indexing device gear does not engage the platen. At the same time, when the gears are in engagement, the hand operated roller does not engage the platen, this feature being provided by a position of the roller over a separate area of the platen on which the elastomer covering is omitted. Both the indexing device and the bail may be retracted, so that the platen may be lifted bodily from or placed in the typewriter.

All of the foregoing improvements facilitate the handling of large or very wide and/or long sheets and are accomplished without impeding the normal use of the typewriter with conventional sizes of paper customarily used with the typewriter.

Additional details of the construction by which the above functions are secured will become evident from the following description, taken in conjunction with the accompanying drawings, in which.

Figure 1:
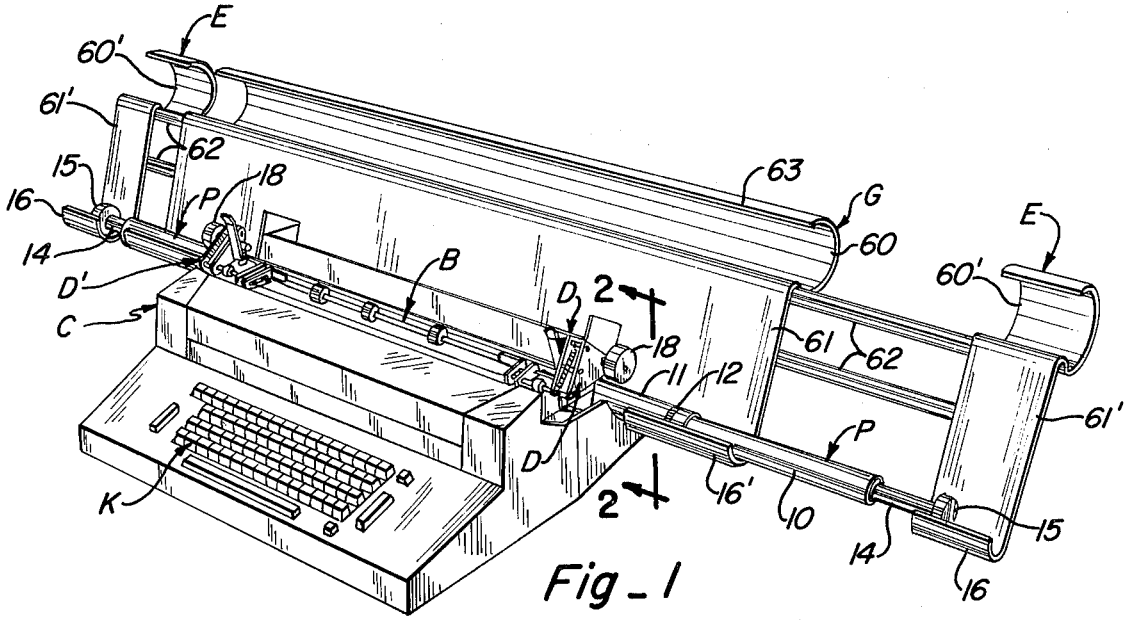
FIG. 1 is a three quarter front perspective view of a typewriter embodying this invention.
Figure 2:
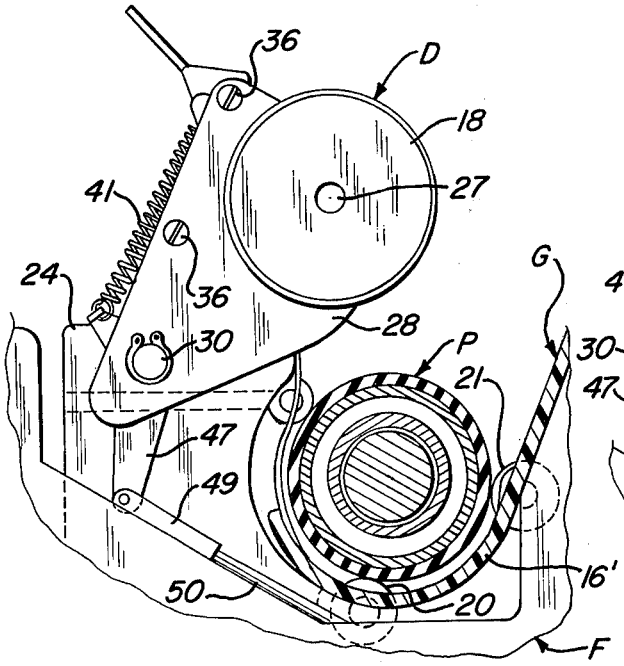
FIG. 2 is a fragmentary vertical section, on an enlarged scale, taken along line 2—2 of FIG. 1, with an indexing device in disengaged position.
Figure 3:
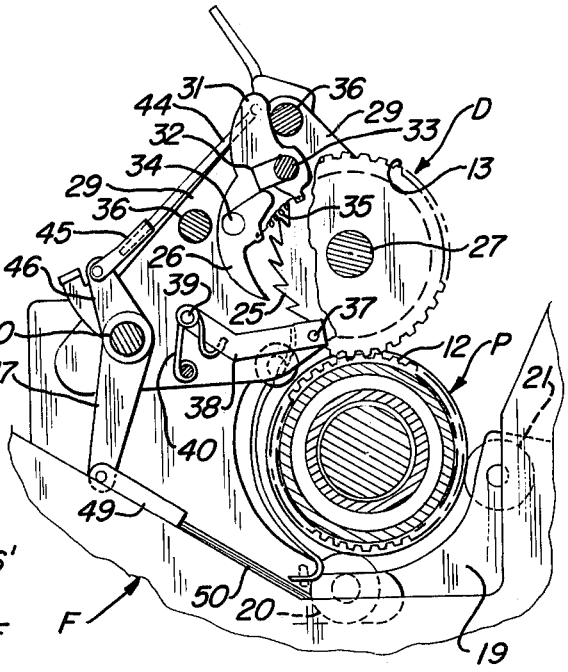
FIG. 3 is a fragmentary vertical section, similar to FIG. 2 but spaced therefrom, being taken along line 3—3 of FIG. 4.

A typewriter constructed in accordance with this invention, as in FIGS. 1–3, may include a cover C enclosing a frame F, on which is mounted a keyboard K which controls the character to be imprinted. Although the principles of this invention are adaptable to typewriters having hinged keys, it is more versatile with the rotatable, laterally movable element on which the characters to be imprinted are placed, particularly the printing element utilized by the IBM "Selectric" typewriter. This typewriter precludes the necessity for a movable carriage, since the typing element is moved laterally, rather than the platen. Thus, a paper guide G constructed essentially as in U.S. Pat. No. 3,900,098 is provided with end extensions E which permit the width of the paper guide to be increased optionally up to nearly double its length when each extension E is moved to extended position. A platen P, which is itself extensible, as will be described later, is supported for rotation at an appropriate position, in a manner described below. The platen P may also be moved to any lateral position of the typewriter. Indexing devices D and D′ are pivotally mounted at each side of the frame F for pivotal movement away from the platen, as in FIG. 2, or into engagement with the platen, as in FIG. 3. A paper bail B is resiliently urged onto the paper passing around the platen P and is preferably adapted to provide a wedging action against the paper, so as to maintain it taut along the platen above and adjacent the positions at which the characters are to be imprinted.

Figure 5:
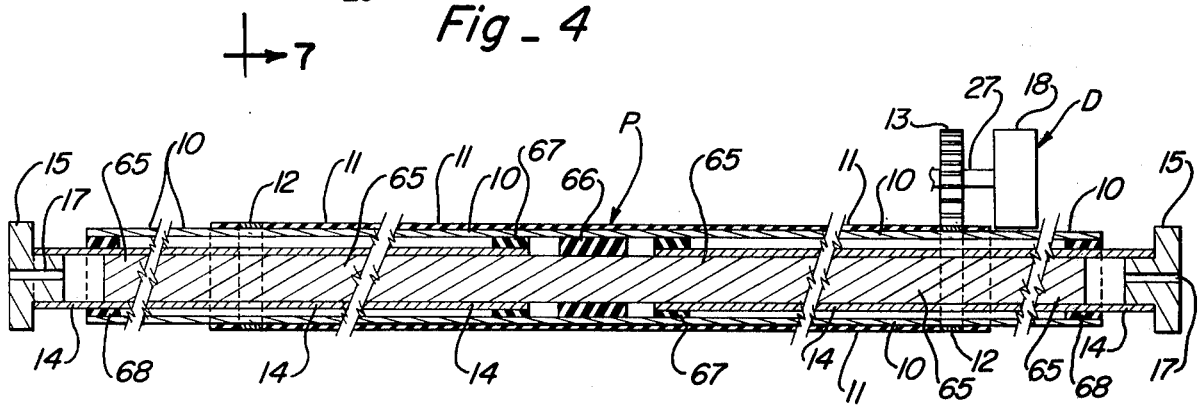
FIG. 5 is a condensed longitudinal section of the free platen of the typewriter of FIG. 1.

The platen P, as in FIG. 5, includes a tube 10 of rust resistant material, such as aluminum, stainless steel or the like, over a predetermined portion of which, such as indicated in FIG. 1, is an elastomer covering 11 which provides a firm but resilient base for supporting the paper, particularly over the area of engagement of the type with the paper. Spaced slightly inwardly from each end of the elastomer covering 11 is a gear ring 12 which is normally engaged by a gear 13 of the indexing device D, as in FIGS. 3 and 5. The distance between the gear rings 12 may be greater than the distance between the indexing devices D and D', so that gear 13 of one indexing device may engage one gear ring 12 but the other gear 13 will be held away from the covering 11, in a manner described below, and the paper may thus extend any desired distance laterally past the non-engaged gear ring 12. The platen further includes a pair of laterally movable extension tubes 14 which are slidable inside the tube 10 and which are closed at their outer ends, as by a plug 15 having a diameter corresponding to the diameter of the platen. As shown, plug 15 may be provided with a central hole 17 to prevent difficulty in adjustment, due to a vacuum or pressure build-up within the platen by movement of extension tube 14. Each indexing device D and D' includes a friction roller 18 which may be used for manual rotation of the platen. As illustrated in FIG. 5, the diameter of the friction roller 18 is the same as the platen but greater than the outer diameter of the gear 13, so that when the friction roller 18 engages the elastomer covering 11, the gear 13 will be spaced from the platen covering. Also, the lateral distance between the gear 13 and roller 18 is greater than the width of elastomer covering 11 beyond the corresponding gear ring 12, so that when the gear 13 is in engagement with the gear ring 12, the corresponding friction roler registers with an uncovered portion of the tube 10, does not contact the platen and thus permits the gear 13 to control the movement or adjustment of the platen. For this reason, the thickness of the elastomer covering should be greater than the difference between the outer diameter of gear 13 and the diameter of roller 18. It will be noted that the friction roller 18 is spaced to the right of gear 13 at the right side, but to the left of gear 13 at the left side.

Figure 9:
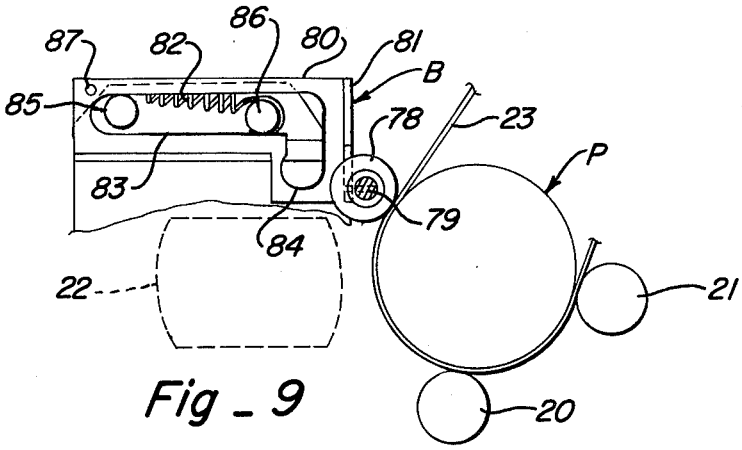
FIG. 9 is a vertical section, on an enlarged scale, taken along line 9—9 of FIG. 8.
Figure 10:
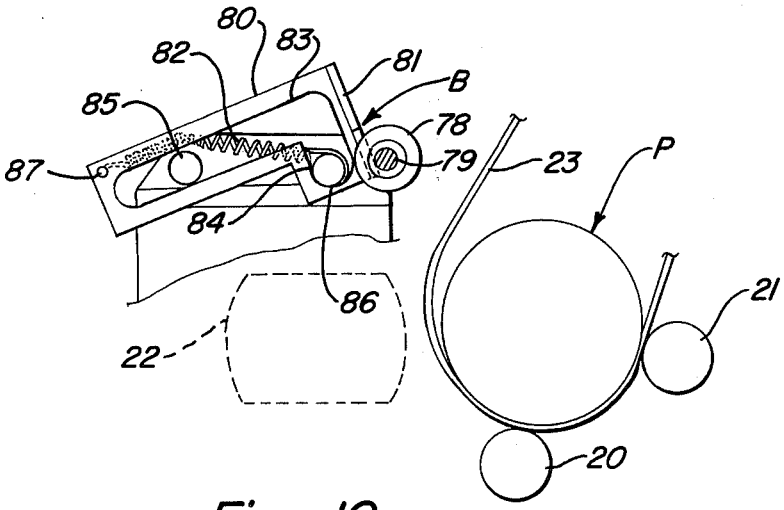
FIG. 10 is a section similar to FIG. 9, but showing the bail in an upper position, away from the platen.

The platen P, as in FIGS. 2, 3, 6 and 7, is supported from a pair of adjustable end plates 19, at each side of the frame, by a bottom roller 20 and a rear roller 21, respectively mounted on each end plate 19. The bottom rollers 20 primarily support and position the platen, while the rear rollers 21 primarily position the platen and resist the impact of the type on the printing element 22 of FIGS. 9 and 10 against the paper 23. It will be understood that paper may engage rollers 20 and 21, as shown, at one, or both sides of the frame F. The rollers 20 are preferably positioned for engagement with the underside of the platen at points spaced slightly forwardly from the vertical centerline thereof, while the rollers 21 are positioned for engagement a slight distance below the horizontal centerline of the platen, so as to be generally in a position opposite the point of engagement of the printing mechanism. As in FIG. 2, a lower curl 16' of the paper guide G extends underneath the platen at each end of the frame F.

Figure 4:
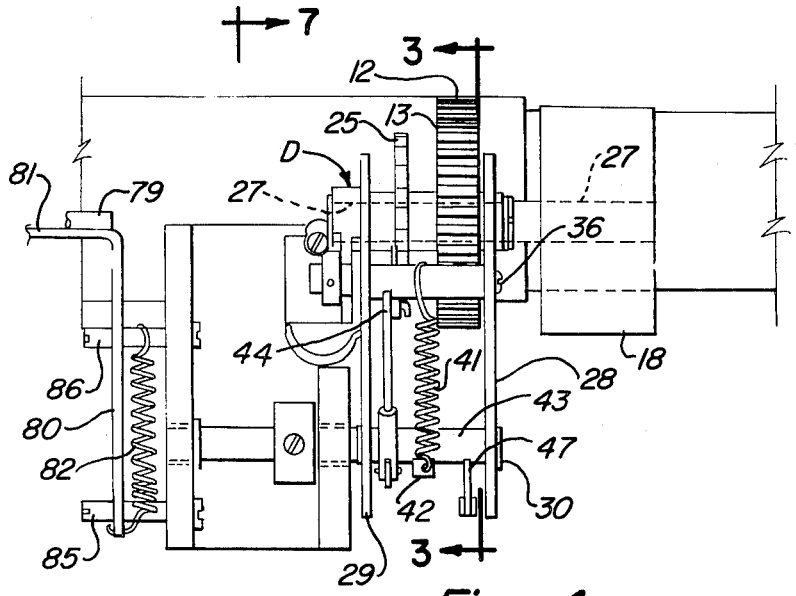
FIG. 4 is a fragmentary top plan view showing the parts visible in FIGS. 2 and 3 and adjacent parts.

Each indexing device D is mounted on an upstanding, fixed end plate 24, as in FIG. 2, and the indexing device D' on a similar end plate at the opposite side of frame F, while the elements of indexing device D' are the same as those of indexing device D, but reversed in lateral position. Indexing device D includes a ratchet 25, as in FIG. 3, positioned for engagement by a pawl 26, with the ratchet being mounted on the same shaft 27 as the gear 13, as well as roller 18. As shown in FIG. 4, ratchet 25, gear 13 and roller 18 are separated by individual bushings engaging shaft 27, while shaft 27 extends between a pair of plates 28 and 29, in turn mounted on a pivot shaft 30 for movement between the positions of FIGS. 2 and 3. Pawl 26 is pivotally mounted on a pawl head 31 provided with a slot 32, the opposite edges of which are engageable with a stop pin 33 for limiting the movement of the pawl 26. When moving in one direction, such as downwardly, the pawl 26 will engage one of the teeth of ratchet 25 to turn the ratchet a distance of one or two, or perhaps more, teeth, in accordance with the adjustment of the actuating elements for the pawl and ratchet, as described below. When moving in the opposite direction, such as upwardly, the pawl 26 will pivot outwardly on pivot pin 34 against the tension of a coil spring 35 in clicking back over the ratchet teeth for engagement with the next ratchet tooth to be moved. Spring 35 also holds pawl 26 in engagement with the desired tooth of ratchet 25 during turning of the ratchet. The plates 28 and 29 are attached together and also spaced apart in parallel relation by a pair of machine screws 36, engaging tubular sockets. Of course, the shafts 27 and 30 also space the plates 28 and 29 apart. The ratchet 25 is prevented from returning, as the pawl 26 is retracted, by a stop pin 37 attached to the outer end of a bar 38 which is pivoted on a pin 39, the stop pin 37 being held against the ratchet by a spring 40.

Figure 6:
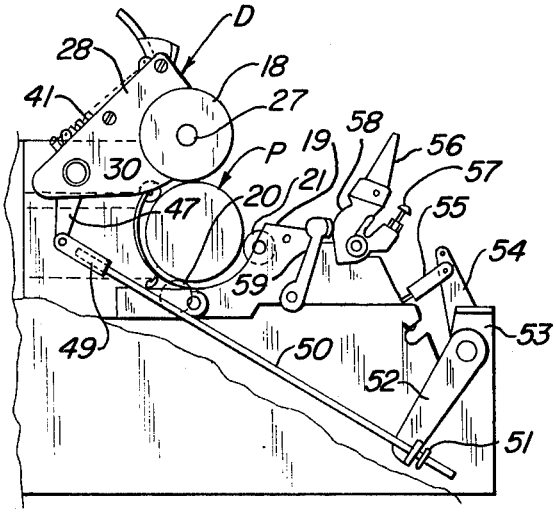
FIG. 6 is a partial end view of the typewriter of FIG. 1, with the paper guide omitted and with parts broken away to show more clearly an indexing mechanism.

Each indexing device D and D' in provided, as in FIGS. 2 and 4, with a spring 41 connected to an ear 42 on a sleeve 43 which is pivoted about shaft 30 each time ratchet 25 is indexed. Spring 41 pulls the actuating parts for pawl 26 back to their original position after the pawl is actuated. Thus, the opposite end of spring 41, as shown, engages a sleeve surrounding one of the screws 36. Spring 41 will be operative in the above manner when device D or D' is held in the down position of FIG. 3. The pawl 26 is actuated through a rod 44 pivotally connected at its upper end to the ratchet head 31 and provided at its lower end with an adjustable pivot connection 45. The latter is pivotally connected, as in FIG. 3, to an arm 46 integral with sleeve 43 and an arm 47 disposed at an obtuse angle thereto, with the sleeve and arms pivotal about shaft 30. An adjustable pivot connection 49 is pivotally connected, as in FIG. 6, to arm 47 and connected to a rod 50 which is pulled in a downward direction to cause pawl 26 to turn ratchet 25. Rod 50 is provided with a lost motion stop 51 beyond an ear through which rod 50 extends, as shown, of an arm 52 forming a part of a yoke pivoted on a post 53. The opposite arm 54 of the yoke is pivotally attached to an adjustable connection 55 which, in turn, is moved angularly downwardly to cause the pawl to turn the ratchet. The remainder of the parts operating through connection 55 by which the pawl is actuated are conventional but operate to actuate the pawl and ratchet through a key of the keyboard K, operating in a conventional manner. Also shown in FIG. 6 is a lever 56 for adjusting the paper engaging rollers described below, the adjustment being conventional, with lever 56 being provided with a set screw 57 for limiting adjustment in the upward direction and a cam surface 58. In turn, cam surface 58 is engaged by a pivot arm 59 through which the adjustment is made to move the lower paper feed rollers upwardly or downwardly.

The paper guide G, as in FIG. 1, is provided with a laterally extending pocket 60 in which a roll of paper or the like may be placed and fed downwardly along a planar surface 61 to the platen P, being guided around the platen by a curl 16' which corresponds in shape to and is in alignment with the curl 16 of each end extension E. Each end extension E is provided with a pocket 60' and a planar surface 61' corresponding to similar parts of the guide G, while movable rods 62 support and permit either or both end extensions E to be moved a desired distance from the guide G. As in my U.S. Pat. No. 3,900,098, the upper front edge 63 of the pocket 60 is spaced rearwardly from a continuation of the plane of planar surface 61, so that paper or the like fed around the platen and thence upwardly will move over the pocket 60 without entering the pocket 60.

In addition to the parts of platen P referred to previously, as in FIG. 5, the platen is provided with a central, cylindrical weight rod 65 formed of a suitable material, such as cast iron or steel, which will render the paper less susceptible to shifting on the platen, due to repeated impacts of the printing element against the paper. A suitable weight for the weight rod 65 may be on the order of 7 pounds for a platen tube 10 which is 30 inches long. As shown in FIG. 5, the diameter of the weight rod 65 is a multiple of the thickness of the platen tube 10. The length of the weight rod 65 is preferably less than the length of the tube 10, while the weight rod is held in position within the platen by a central bushing 66 which is formed of a suitable plastic which will resist lateral movement, although insufficient to prevent the weight rod to be inserted in and removed from the tube 10. Preferably the bushing 66 maintains the weight rod 65 in a central position, so that the space between the outside of the weight rod 65 and the inside of the tube 10 is substantially the same, both longitudinally and circumferentially. The extension tubes 14, which are slidable from the opposite ends of the platen, are provided with an inner diameter differing from the outer diameter of the weight rod such that an easy sliding fit is obtained. At its inner end, each extension tube 14 is provided with a fixed inner bushing 67 which moves with the inner tube and slides along the inside of the main platen tube 10. The outside of the tube 14 is also guided by an outer bushing 68 which also acts as a stop when engaged by bushing 67, to limit outward movement of the extension tube 14. The bushings 66, 67 and 68 are conveniently formed of plastic, while central bushing 66 may be attached, as by an adhesive, either to the inside of tube 10 or the outer surface of weight rod 65. The bushing 67 may be attached by adhesive or molded onto the inner end of the corresponding extension tube 14, while the bushing 68 may be attached by adhesive, or otherwise secured, to the inside of the platen tube 10 at the opposite ends thereof.

Figure 7:
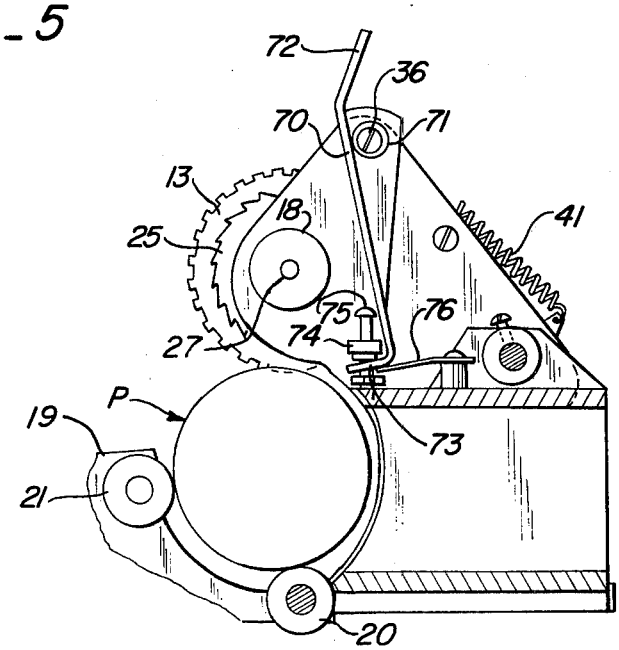
FIG. 7 is a vertical section, taken in a direction opposite that of FIG. 3 and along line 7—7 of FIG. 4.

The spring 41 will tend to move the indexing device D or D' to an upper position whenever the indexing device is not locked in its normal down position. In order to lock the indexing device D or D' in the downward position of FIG. 3, a lever 70 of FIG. 7 is attached to a sleeve 71 pivotal on a screw 36, so that the indexing device may be moved downwardly by a handle 72, and the forked, transversely extending lower end 73 of the lever may be moved under an adjustable stop nut 74 mounted on a screw 75. A leaf spring 76 is depressed by the lower end fork 73 of lever 70 as it is moved into the holding position illustrated in FIG. 7, and will maintain fork 73 against nut 74, when handle 72 is released. As will be evident, when the operator wishes to release either indexing device, he merely pushes forwardly on the handle 72 to release lever fork 73 and moves the indexing device rearwardly to the upper position of FIG. 2. For maintaining an indexing device in the upper position of FIG. 3, fork 73 may be placed on top of nut 74, or on top of screw 75. For moving the indexing device back to the platen engaging position of FIG. 3, the operator pushes down on the indexing device, and at the same time, moves the handle 72 slightly forwardly. Then, while holding the indexing device in down position, he merely pulls rearwardly on handle 72 to cause fork 73 to slip under nut 74.

Figure 8:
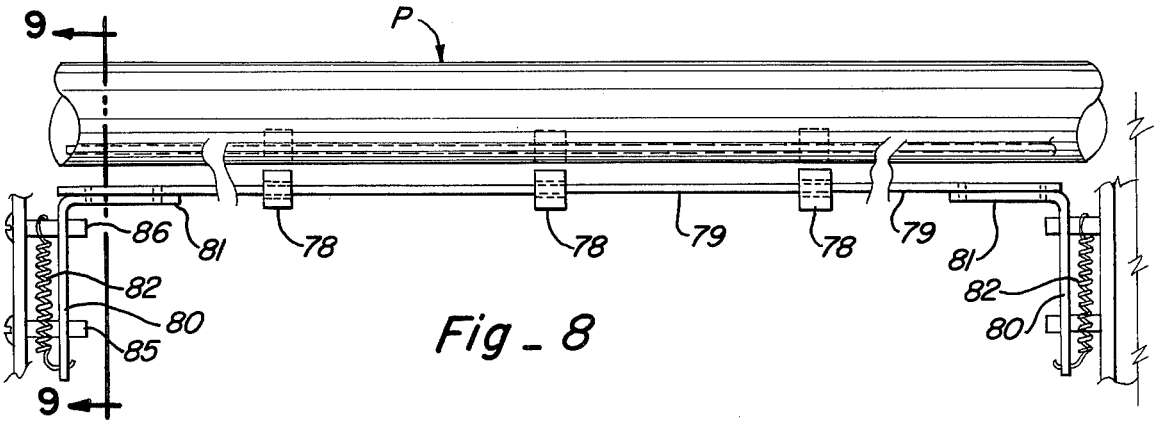
FIG. 8 is a top plan view of the platen, a bail and the bail actuating devices, with other parts being omitted for clarity of illustration.

As indicated previously, the bail B is adapted to produce a wedging action against the paper, pushing it upwardly on the platen and thereby assisting in the prevention of any creep of the paper. The weight of the platen, of course, also assists in preventing creep due to the paper being held between the platen and the support rollers and/or feed rollers. The pressure exerted by the bail B is supplied, as in FIGS. 8–10, by a series of rollers 78 mounted for rotation about a rod 79, i.e. to rotate when moved by the paper. Each end of rod 79 is mounted on a bracket 80 having a lateral flange 81 to which the respective ends of rod 79 are attached, while each bracket 80 is urged toward the platen by a spring 82. Each bracket 80 is also provided with a horizontal slot 83, having a downward extension 84 at the front. In the normal position of the bail B, during typing, the horizontal slot 83 engages a pair of pins 85 and 86, with the tension from spring 82 urging each bracket 80 forwardly. The front end of spring 82 is connected to front pin 86, while the rear end of spring 82 is connected to a hole 87, at the rear upper corner of bracket 80. In the position shown in FIG. 9, the pins 85 and 86 in slot 83 insure that any movement is in essentially a straight line and forwardly. However, the slack between pins 85 and 86 and the slot 83, i.e. the difference between the diameter of the pins and the width of the slot, tends to cause the rollers 78 to climb up onto the paper and thereby hold the paper tightly against the platen. Contributing to the wedging action of rollers 78 against the paper is the direction of the force thrust of springs 82 which is directed by pins 85 and 86 at an acute angle to tangents to the circumference of platen P at the points of contact by rollers 78. However, the operator may move the bail B back to the spaced position of FIG. 10, as by rearward pressure on the lateral flange 81 of the respective brackets 80, until pin 86 moves into the depending slot 84, so that the rear edge of slot 84 will abut pin 86 to hold the bail in this position. When the operator wishes to return the bail to its typing position, downward pressure on lateral flange 81 is all that is necessary to cause the front of the bail to move downwardly until the longitudinal slot 81 is in line with the pins 85 and 86, whereupon the tension of spring 82 can move the brackets 80 forwardly until the rollers 78 engage the paper 23.

Figure 11:
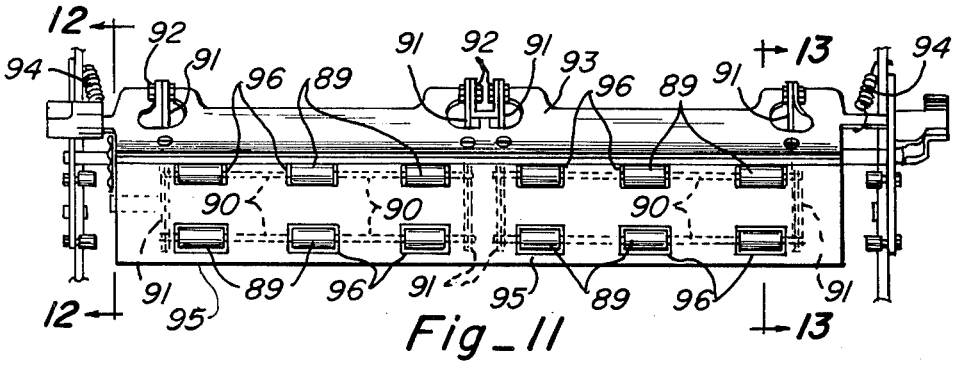
FIG. 11 is a top plan view of the paper engaging rollers on the underside of the platen and a support therefor.
Figure 12:
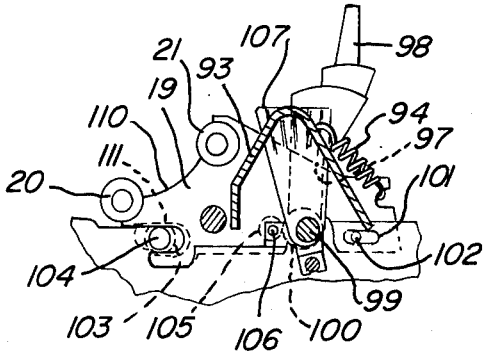
FIG. 12 is a vertical section taken along line 12—12 of FIG. 11.
Figure 13:
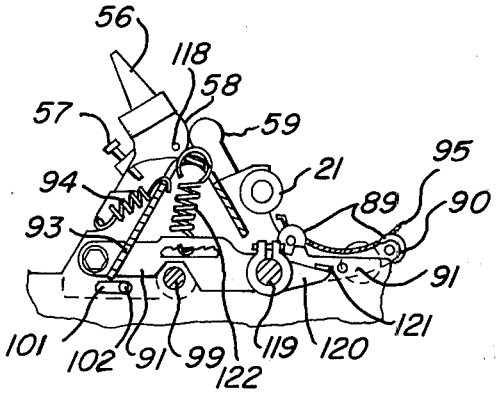
FIG. 13 is a vertical section taken along line 13—13 of FIG. 11.

The parts shown in FIGS. 11-13 include primarily parts of a conventional IBM "Selectric" typewriter, with modifications to the end plates and the feed roller adjusting mechanisms. Thus, a series of laterally and longitudinally spaced paper feed rollers 89 are mounted on pins 90, in turn supported by arms 91 which are pivoted at one end on brackets 92 of an "A-frame" 93, with the rollers being adjustable upwardly and downwardly, relative to the A-frame, and the A-frame being held in position by a pair of coil springs 94. A paper shield 95, arcuate about a radius corresponding to the platen, is mounted in a conventional manner and provided with slots 96 to accommodate paper feed rollers 89.

Figure 14:
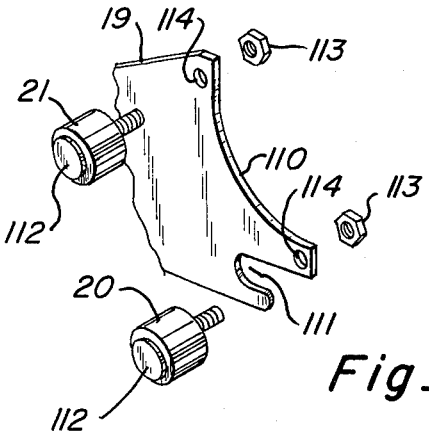
FIG. 14 is an exploded perspective view of an adjustable end plate for the platen and the platen supporting rollers attached thereto.

The end plates 19 are also mounted on A-frame 93 and may be adjusted, by the operator, forwardly and rearwardly, to accommodate changes in paper thickness, the adjustment being accomplished through an arm 97 having a handle 98 to turn a shaft 99 and a cam 100 on the shaft, which moves both plates 19 and, with them, the entire A-frame assembly and the platen, forwardly or rearwardly. A slot 101 in each plate 19 engages a guide pin 102, to guide each plate 19 during forward or rearward mechanical adjustment. A cam 103 may be turned by a shaft 104 to mechanically adjust the corresponding end plate upwardly or downwardly at each position, while a cam 105 may be turned by a shaft 106 to mechanically adjust the corresponding end plate forwardly or rearwardly. Handle 98 is provided with a detent (not shown) engaging a ribbed plate 107, to maintain lever 97 in its operator adjusted position. Each plate 19, as in FIG. 14, is provided with a front arcuate surface 110 and a lower slot 111 engaged by cam 103, as in FIG. 12, while each roller 20 and 21 is mounted on the unthreaded portion of a pin 112, the opposite end of which is threaded for engagement with a nut 113 after insertion into a hole 114 in plate 19. Slot 111 also cooperates with cam 103 in guiding the respective end plate during forward or rearward adjustment.

Lever 56, as in FIG. 13, is pivoted about a pin 118, so that its cam surface 58 will, upon pivotal movement of lever 56, move cam follower 59 forwardly or rearwardly. This movement is translated upon into an up or down movement of rollers 89. Cam follower 59 is connected to a shaft 119 having a tongue 120 engaging the underside of an ear 121 extending laterally from the adjacent arm 91 for lifting or lowering arms 91 and the rollers 89 with it. Springs 122 hold the arms 91 upwardly and the rollers 89 in engagement with the paper, but the ear 121 against tongue 120 prevents downward movement beyond its adjustment and thus is responsible for the desired pressure against the platen. Set screw 57 is mechanically set to provide upward pressure of the paper feed rollers to equalize the gravitational pressure of the weighted plate.

Although a preferred embodiment of this invention has been illustrated and described, it will be understood that other embodiments will exist and that various changes may be made, without departing from the spirit and scope of this invention.

What is claimed is:

1. In a typewriter having a frame and keyboard means for controlling means for imprinting characters on a sheet:

a free platen around which said sheet may be moved by turning said platen, for imprinting characters thereon, said platen having free ends and being movable to different endwise positions;

an end plate at each side of said typewriter and each constructed and arranged to permit paper or the like to be moved around said platen and to extend from said plates laterally beyond either or both of said end plates;

means for producing relative longitudinal movement between said character imprinting means and said platen;

first supporting rollers rigidly mounted on said end plates and engaging the underside of the platen at each side, for supporting and positioning said platen, said first rollers engaging said platen below the horizontal centerline of said platen and forwardly of the vertical centerline of said platen but closer to the vertical centerline of said platen than to the horizontal centerline thereof;

second supporting rollers rigidly mounted on said end plates and engaging the rear side of said platen at each side, for supporting and positioning said platen in conjunction with said first rollers, said second rollers engaging said platen below the horizontal centerline of said platen, rearwardly of the vertical centerline of said platen and essentially opposite the point of impact of said character means, said endwise movability of said platen being with respect to said rollers and said end plates; and paper feed rollers between said end plates at both longitudinally and circumferentially spaced positions relative to the underside of said platen and adjustable toward and away from said platen separately from both said first and second rollers and resiliently urged against said platen.

2. In a typewriter as defined in claim 1, including:

means for adjusting said first and second rollers, forwardly and rearwardly and upwardly and downwardly, independently of said paper feed rollers.

3. In a typewriter as defined in claim 1, wherein:

said platen includes a tube and an elongated weight disposed within said tube and extending longitudinally thereof, said weight providing inertia against movement of said platen from the impacts of imprinting characters and having sufficient weight to resist an upward thrust of said paper feed rollers sufficient to maintain said paper in engagement with said platen during the imprinting of characters without lifting the platen from said first and second rollers.

4. In a typewriter as defined in claim 1, including:

means for urging said sheet against said platen at positions adjacent and above the impact area of said imprinting means.

5. In a typewriter as defined in claim 4 wherein said sheet urging means includes:

a rod parallel to said platen and provided with rollers for engaging said sheet; and means for resiliently urging said rod toward said platen by an essentially horizontal force directed toward the circumference of said platen at the point of engagement of said sheet covered platen by said rollers.

6. In a typewriter as defined in claim 5, wherein:

said resilient urging means include movable elements attached to the respective ends of said rod; and a spring acting on each movable element to urge said rod toward said platen.

7. In a typewriter as defined in claim 6, wherein:

said movable elements include an upright plate at each side and attached to each end of said rod, each said plate having a slot provided with a downward front offset;

a pair of aligned guide pins for and engageable with each said slot; and spring means for urging said elements toward said platen, one of said pins engageable with the offset in said slot for retaining said plates and rod in a position away from said platen.

8. In a typewriter as defined in claim 1, including:

indexing means including gear means for turning said platen in predetermined increments; and friction roller means for alternatively turning said platen through engagement with said platen at a position spaced from said sheet or engagement with said sheet at a position at which said sheet covers said platen.

9. In a typewriter as defined in claim 8, wherein:

said platen is provided with a covering of an elastomer adapted to receive the impact of typing characters striking the paper extending around the platen; and said gear means includes a ring gear mounted on said platen but flanked on each side by said elastomer and extending radially for a distance no greater than said elastomer.

10. In a typewriter as defined in claim 9, wherein:

said elastomer covering in the direction of the free end of said platen extends for a predetermined distance from said ring gear; and said friction roller means is disposed outwardly from a gear of said indexing means a greater distance than said predetermined distance.

11. In a typewriter as defined in claim 8, wherein:

said friction roller means comprises a roller mounted on said indexing means and said gear means includes a gear mounted on said indexing means;

the maximum diameter of said roller is greater than the maximum diameter of said gear; and said indexing means includes a ratchet means for turning said gear and said roller in increments.

12. A free platen typewriter having means for supporting said platen at points a predetermined distance apart and means for imprinting characters at selected positions on a sheet extending around said platen, said platen having free ends, being movable to different endwise positions, receiving a sheet extending around the same having a width greater than the length of said platen and including:

a tube having a length greater than said predetermined distance;

a covering of an elastomer extending on said tube for a length greater than said predetermined distance;

tubular end extensions slidable within said tube from the opposite ends thereof and adapted to receive a sheet extending around both of said extensions, when fully extended, and wider than the combined length of said platen and the fully extended extensions;

a weight disposed within said tube and extending longitudinally thereof, said weight being cylindrical and having an outer diameter less than the inner diameter of said platen tube; and said tubular end extensions surrounding and being slidable along said weight between said weight and the elastomer covered portion of said tube.

13. A free platen typewriter as defined in claim 12, wherein:

the diameter of said weight is a multiple of the thickness of said platen tube.

14. A free platen typewriter having means for supporting said platen at points a predetermined distance apart and means for imprinting characters at selected positions on a sheet extending around said platen, said platen having free ends, being movable to different endwise positions, receiving a sheet extending around the same having a width greater than the length of said platen and including:

a tube having a length greater than said predetermined distance;

a covering of an elastomer extending for a length greater than said predetermined distance;

tubular end extensions slidable within said tube from the opposite ends thereof;

a weight disposed within said tube and extending longitudinally thereof, said weight being cylindrical and having an outer diameter less than the inner diameter of said platen tube;

a central bushing of limited extent engaging the inside of said tube and the outside of said weight for supporting said weight centrally of said tube;

said tubular end extensions surrounding and being slidable along said weight and being provided at the inner ends with ring-shaped bushings which are slidable with said tubular end extensions; and said tube being provided adjacent each end with an inside, ring-shaped bushing surrounding the corresponding tubular end extension.

* * * * *